US005752427A

United States Patent [19]

Leutner

[11] Patent Number: 5,752,427

[45] Date of Patent: May 19, 1998

[54] ADJUSTABLE HYDRO-STATIC RADIAL PISTON MACHINE

[75] Inventor: Volkmar Leutner, Friolzheim, Germany

[73] Assignee: Robert Bosch GmbH, Stuttgart, Germany

[21] Appl. No.: 719,576

[22] PCT Filed: Feb. 24, 1996

[86] PCT No.: PCT/DE96/00313

§ 371 Date: Sep. 25, 1996

§ 102(e) Date: Sep. 25, 1996

[87] PCT Pub. No.: WO96/32589

PCT Pub. Date: Oct. 17, 1996

[30] Foreign Application Priority Data

Apr. 13, 1995 [DE] Germany ..... 195 13 987.9

[51] Int. Cl.[6] ..... F04B 1/06

[52] U.S. Cl. ..... 91/497; 417/63; 417/217; 417/273

[58] Field of Search ..... 417/212, 218, 417/219, 220, 273, 63; 91/497, 498

[56] References Cited

U.S. PATENT DOCUMENTS 4,601,641 7/1986 Kuroyangi et al. ..... 417/219

4,711,616 12/1987 Tsukahara et al. ..... 417/219

FOREIGN PATENT DOCUMENTS 3429542 2/1986 Germany ..... 417/219

*Primary Examiner*—Charles G. Freay
*Attorney, Agent, or Firm*—Michael J. Striker

[57] ABSTRACT

A hydrostatic radial piston machine 10 is proposed, whose adjustable reciprocating ring 18 has integrated means for detecting the eccentricity 20 between the reciprocating ring 18 and the rotor 14. In combination with the rotating rotor 14 and the binding of the sliding blocks 17 to this reciprocating ring 18, the eccentric location of the reciprocating ring 18 leads to a reciprocating motion of the work pistons 16 in a radial direction. Together with the kinematic conditions in the radial piston machine 10, this leads to a change in the spacing between two successive sliding blocks 17. This change in spacing varies in proportion to the eccentricity 20 of the reciprocating ring 18 and is therefore detected by a measuring instrument. To that end, this measuring instrument has a measured value pickup 27, which is integrated in the reciprocating ring 18 and outputs an increased voltage signal as long as sliding blocks 17, which act as measured value transducers, move past it. The signal course is delivered to an electronic evaluation unit 28 and used by it to determine eccentricity, rotor rpm, and other characteristic variables.

7 Claims, 2 Drawing Sheets

10
11
12
13
14
15
16
17
17.1
17.2
17.3
18
20
22
23
24
25
26
26
27
28

ADJUSTABLE HYDRO-STATIC RADIAL PISTON MACHINE

PRIOR ART

The invention is based on a hydro-static radial piston machine with an adjustable reciprocating ring.

Such a machine is generally known. It is used in many applications in hydraulics, since by its use it is possible to reduce the expense for open and/or closed-loop control valves. The major advantages in drives for such radial piston machines, besides the simplicity of the design, is that they have little loss and the machine can be electrically triggered quickly and precisely. For triggering, adjusting pistons acted upon by pressure and integrated into the machine housing are used; they act on the outer circumference of the reciprocating ring along its adjusting direction. The eccentricity of the reciprocating ring, which is proportional to the supply quantity of the machine, can be used as a controlled variable and detected by an inductive travel pickup. This actual value is compared with a guide value by an electronic closed-loop control amplifier and serves to regulate the position of the reciprocating ring. In some applications it is unfavorable that this inductive travel pickup cannot be disposed anywhere else than in an extension of the adjusting piston, thus making the machine even larger, in what is already its largest dimension. Since the travel pickup is an additional part to be mounted, the structural expense of the machine is also increased.

German Patent Disclosure DE 35 13 736 A1 has also disclose a hydro-static radial piston machine with a measuring instrument for detecting the eccentricity of a rotatably supported eccentric ring. A hydraulic rod linkage transmits the deflection of a transducer tappet, which is supported on the inside of the eccentric ring, and whose deflection is dependent on the eccentricity of the eccentric ring, to a receiver tappet. The latter is provided with a coil core, which in accordance with the existing eccentricity of the eccentric ring plunges to a variable depth in a measuring coil and trips a measurement signal there. This measuring instrument has many mechanical components and entails major expense for the hydraulic coupling; signal pickup must take place in a rotating machine shaft.

ADVANTAGES OF THE INVENTION

The electrohydraulically adjustable machine of the invention has the advantage over the prior art that the means used comprise inexpensive measuring instruments that are integrated in already existing components of the machine, or that existing machine components can be used as measured value transducers. As a result, neither the structural volume nor the expense for construction of the machine is increased.

Another advantage is that a digital measurement signal is present that can be used by an electronic circuit both to determine the eccentricity of the reciprocating ring and to determine the rpm of the rotor, and for further functions optionally as well, such as for damping noise in the machine.

It is also worth noting that the scanning time is flexible within certain limits, depending on the demands of a given application, because the number of slide blocks used as measured value transducers can be varied. The shortest scanning times can accordingly be attained if all the slide blocks are used as measured value transducers. Another favorable aspect is that the measuring instrument operates in contactless fashion and is therefore subject to neither friction nor wear, which is expressed in a long service life and low maintenance.

Other advantageous features will become apparent from the specification.

DRAWING

One exemplary embodiment of the invention is shown in the drawing and described in further detail in the ensuing description.

FIG. 1 shows a cross section of a radial piston machine in a simplified illustration; and FIG. 2 is a graph showing the course of the signal generated in the measured value receiver as a function of time and of the rotational angle of the rotor.

DESCRIPTION OF THE EXEMPLARY EMBODIMENT

Figure 1:
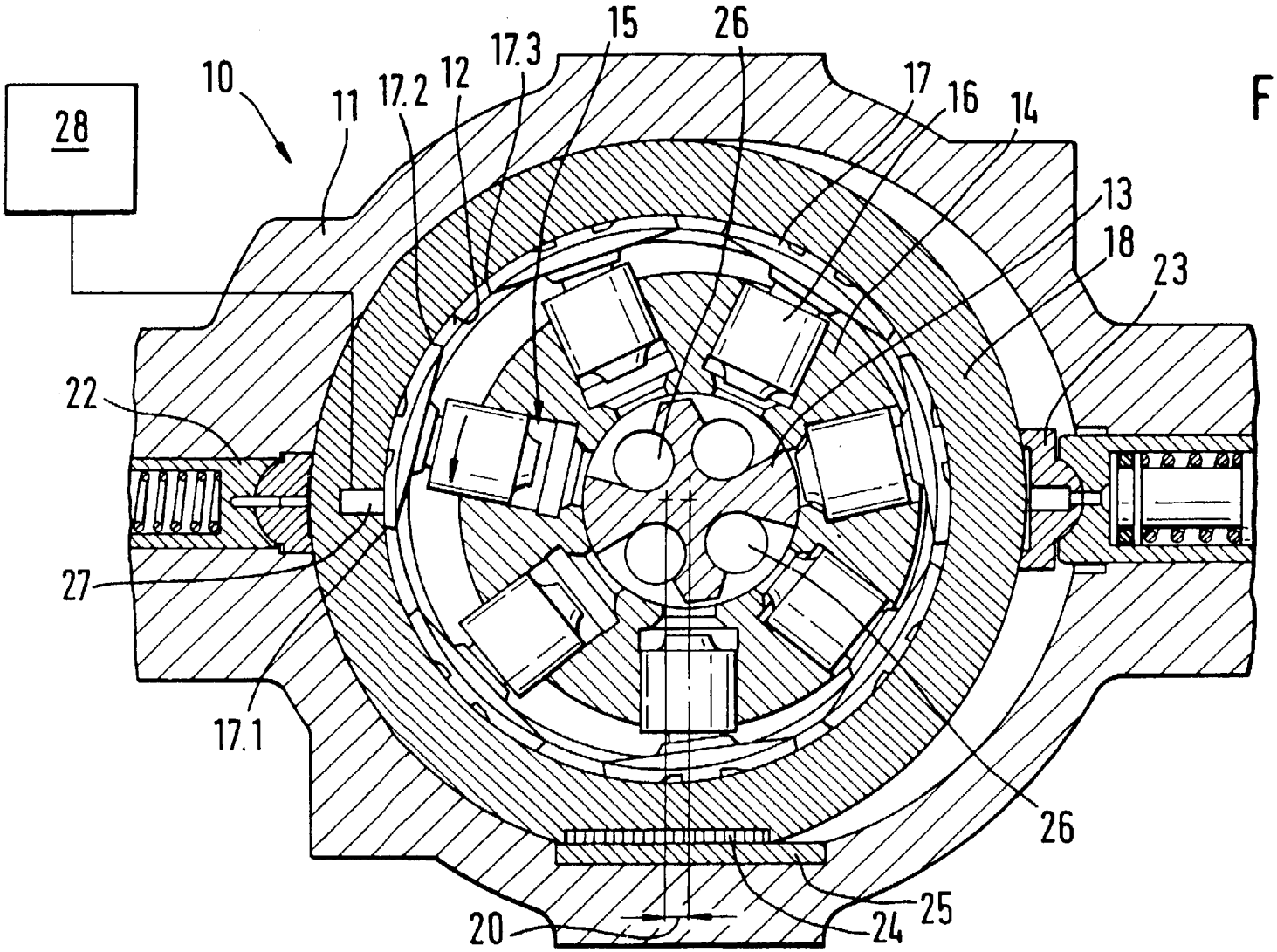

FIG. 1 shows a radial piston machine 10, whose housing is closed off by a cap, not shown. A substantially cylindrical recess 12 is formed, sealed off from the outside, in the housing 11, and a control protrusion 13 supported in stationary fashion in the housing protrudes centrally into this recess. A rotor 14 is rotatably supported on a part of this control protrusion, and in it a plurality of radially extending bores 15 form cylinders in which work pistons 16 slide. These work pistons 16 are pivotably connected to slide blocks 17, which protrude out of the bores 15 of the rotor and which are bound by retaining rings, not shown in detail, movably on a cylindrical reciprocating ring 18. The inside of the reciprocating ring forms the running surface for these slide blocks 17. The reciprocating ring is fixed in its position by two hydraulic adjusting pistons 22 and 23, which are disposed diametrically opposite one another in the housing and form an adjusting device. The position of the reciprocating ring 18 is variable inside the recess in the direction defined by the adjusting pistons 22 and 23. Flattened faces 24 on the outer circumference of the reciprocating ring and 25 on the housing, provided parallel to the adjusting direction, serve as a guide in the displacement of the reciprocating ring in the adjusting direction, and at the same time they secure it against rotation. Control slits, not visible at the level of the rotor in FIG. 1, are formed in the control protrusion 13; via lengthwise conduits 26 and openings also made in the control protrusion 13, these slits communicate with conduits extending radially in the housing and penetrating to the outside. These conduits 26 form suction and compression channels and they carry the hydraulic medium into the machine 10 and under pressure back out again. The angular position of the rotor 14 on the control protrusion 13 is embodied such that the lands located between the control slits in the control protrusion 13 are located in a region in which the work pistons 16 are at their dead center points. The rotor 14 is set into rotational motion by a drive shaft located in the cap, via a coupling, also not shown.

As FIG. 1 shows, the radial piston machine 10 has a measuring instrument for detecting the eccentricity 20 of the reciprocating ring 18 acting as an adjusting device; the measuring instrument has one measured value pickup 27 in the reciprocating ring 18 and a plurality of measured value transducers. The slide blocks 17 of the work pistons 16 serve as the measured value transducers. The signal tripped in the measured value pickup is carried to an electronic evaluation unit 28.

The mode of operation of the adjustable radial piston machine 10 will be described below; its basic function in conjunction with the hydraulic adjusting device is assumed to be known per se.

In the radial piston machine 10, shown in FIG. 1 as a counterclockwise-rotation machine, the reciprocating ring 18 is adjusted maximally to the left via the adjusting device, producing an eccentricity 20 between the reciprocating ring 18 and the rotor 14. The aforementioned binding of the slide blocks to the reciprocating ring 18, in combination with its eccentric position relative to the rotor 14, forces the work piston 16, connected pivotably via the slide blocks 17, to execute a reciprocating motion radially in the rotor 14 in the rotational motion of the rotor. As a consequence of this reciprocation, in combination with the kinematic conditions in the radial piston machine 10, the spacing between two successive slide blocks changes.

This change in spacing, referred to the existing spacing in the neutral position of the machine (reciprocating ring eccentricity=0) is proportional to the eccentricity 20 of the reciprocating ring 18 and is therefore used to detect this eccentricity 20.

In the direction of the adjusting devices 22 and 23 of the reciprocating ring 18, the aforementioned spacing assumes an extreme value, which is why for the most accurate possible detection of the eccentricity 20 it is advantageous if the measured value pickup 27 is disposed there, as shown in FIG. 1.

In principle, this pickup outputs a voltage as a signal as long as a sliding block 17 is located above it. For instance, if the front edge 17.1 of the sliding block 17, that is, the front edge in terms of the direction of rotation, reaches the measured value pickup 27, in the course of the signal 30 this leads to a voltage rise 32 to a higher level 33, which is preserved until the rear edge 17.2, in terms of the rotational direction, of the sliding block 17 has slid past the measured value pickup 27. The voltage signal then returns to the original level 34, and as a result a trailing edge 35 occurs in the signal course 30. Until the front edge 17.3 of the next sliding block has reached the measured value pickup 27, the voltage signal remains at this low level 34, and this is followed by a new voltage rise 32, and so forth.

The time lag 36 between the successive leading and trailing voltage edges in the signal course is a direct measure for the spacing that exists between the associated sliding blocks, and as already noted above this spacing is proportional to the eccentricity of the reciprocating ring 18.

Figure 2:
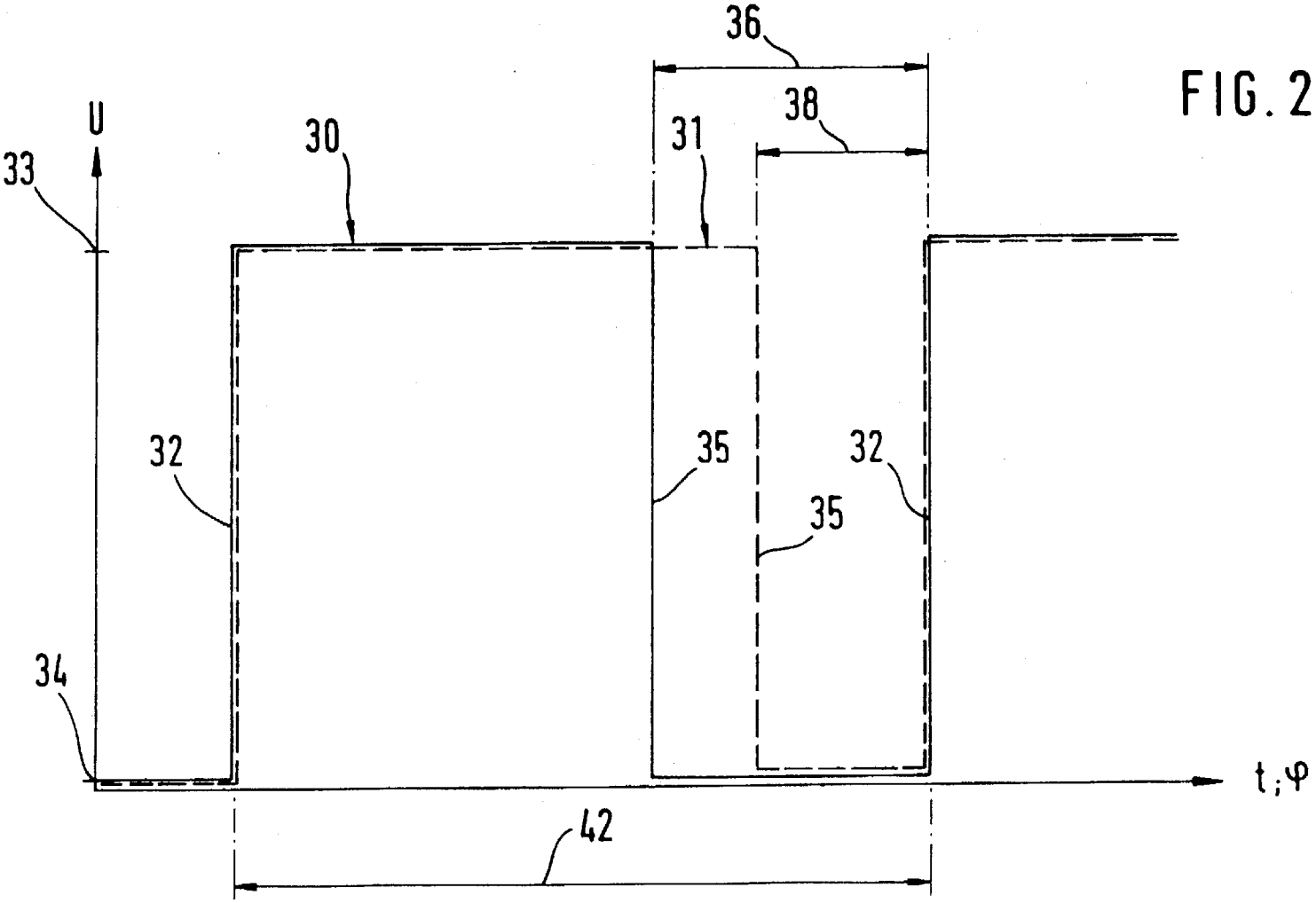

If the reciprocating ring 18 is moved out of its position shown in FIG. 1 into its neutral position, for instance, then a signal course 31 (dashed line) shown in FIG. 2 is generated in the measured value pickup 27. The decrease in spacing between two successive sliding blocks 17 is expressed in a shorter time interval 38 between the trailing and leading signal edges.

The signal course 30 or 31 is now processed by an electronic evaluation unit 28 in such a way that a trailing edge 35 in the signal course starts a counter that has a high-frequency counting sequence. This counter is stopped by a trailing edge 32; the counting frequency should be adapted once and for all such that the outcome of counting is equivalent to the existing eccentricity 20. The eccentricity 20 of the reciprocating ring 18 can thus be ascertained continuously over the entire adjustment range of the reciprocating ring 18.

To detect the rpm of the rotor 14, the electronic evaluation unit 28 detects the time 42 between two leading voltage edges 32, which is inversely proportional to the machine rpm. The volumetric flow of the machine can be detected via the two measured variables, that is, the rpm and the eccentricity.

In such a measuring instrument, the possible scanning interval between two signals depends both on the rotor rpm and on the number of sliding blocks 17 of the machine that are used as measured value transducers. Given a typical industrial rotary speed of 1500 rpm and seven work pistons with sliding blocks, for instance, a scanning interval of approximately 5.7 ms can be defined, which is adequate for most applications.

It is understood that changes in the embodiment shown are possible without departing from the concept of the invention. For instance, for the contactless operating principle of the measuring instrument, various methods are suitable; an inductive, optoelectronic or magnetic operating principle is especially advantageous.

I claim:

1. An adjustable hydrostatic radial piston machine (10) with a housing (11), in which a rotor (14) is rotatably supported on a control protrusion (13), which rotor cooperates with a drive shaft and guides work pistons (16) in radially arranged bores (15), the ends of which pistons protruding from the bores (15) are equipped with sliding blocks (17) pivotably supported on the work piston (16), which sliding blocks are supported on the inside of a reciprocating ring (18) which is adjustable eccentrically relative to the rotor (14) via a device that has at least one adjusting piston (22), which acts on the outer circumference of the reciprocating ring (18) along the adjusting direction thereof, and with means for detecting the eccentricity of the reciprocating ring, wherein the means have a measuring instrument and an electronic evaluation unit (28) cooperating with it, which derive the eccentricity (20) of the reciprocating ring from the spacing between two successive sliding blocks (17).

2. The radial piston machine (10) claim 1, wherein the measuring instrument has a measured value pickup (27) which is disposed in the reciprocating ring (18) and borders the inside of the reciprocating ring (18).

3. The radial piston machine (10) as defined in claim 1, wherein the measuring instrument uses at least two sliding blocks (17), which are located one after the other in the direction of rotation, as measured value transducers.

4. The radial piston machine (10) as defined in claim 2, wherein the measured value pickup is located in a region of the reciprocating ring (18) in which the spacing between two sliding blocks (17) moving past it assumes an extreme value.

5. The radial piston machine (10) as defined in claim 1, wherein the measuring instrument operates by a contactless operating principle.

6. The radial piston machine (10) as defined in claim 1, wherein the reciprocating ring (18) is secured against rotation in the housing (11), to which end slide faces (24 and 25) are embodied on the reciprocating ring (18) and the housing (11), the slide faces extending parallel to the adjusting direction.

7. The radial piston machine as defined in claim 4 wherein the reciprocating ring is disposed essentially coaxially to the direction defined by the adjusting pistons (22 and 23).

* * * * *